US012104615B2

(12) United States Patent
Kamimura et al.

(10) Patent No.: US 12,104,615 B2
(45) Date of Patent: Oct. 1, 2024

(54) TURBO TYPE PUMP AND FLUID SUPPLY UNIT

(71) Applicant: Komatsu Ltd., Tokyo (JP)

(72) Inventors: Shinichi Kamimura, Tokyo (JP); Satoshi Kiuchi, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 18/265,484

(22) PCT Filed: Jan. 31, 2022

(86) PCT No.: PCT/JP2022/003493

§ 371 (c)(1),
(2) Date: Jun. 6, 2023

(87) PCT Pub. No.: WO2022/176583

PCT Pub. Date: Aug. 25, 2022

(65) Prior Publication Data

US 2024/0035484 A1 Feb. 1, 2024

(30) Foreign Application Priority Data

Feb. 22, 2021 (JP) ..... 2021-026617

(51) Int. Cl.
*F04D 29/42* (2006.01)
*F04D 1/00* (2006.01)
*F04D 13/12* (2006.01)

(52) U.S. Cl.
CPC ..... *F04D 29/4206* (2013.01); *F04D 1/00* (2013.01); *F04D 13/12* (2013.01)

(58) Field of Classification Search
CPC ... F01D 1/00; F04D 13/12; F04D 9/04; F04D 29/4206; F04D 29/426; F04D 29/4293; F04D 29/4213; F04D 29/688; F04D 29/681
See application file for complete search history.

(56) References Cited

U.S. PATENT DOCUMENTS 3,643,431 A * 2/1972 Jamieson ..... F01D 9/00 60/39.23
2013/0183155 A1* 7/2013 Stoicescu ..... F04D 9/04 416/175
2016/0230650 A1* 8/2016 Mohtar ..... F02B 37/24
(Continued)

FOREIGN PATENT DOCUMENTS

EP 661450 A1 7/1995
JP H4-32271 U 3/1992
(Continued)

*Primary Examiner* — Juan G Flores
*Assistant Examiner* — Ryan C Clark
(74) *Attorney, Agent, or Firm* — Locke Lord LLP

(57) ABSTRACT

A turbo type pump configured to pressurize a fluid and supply the fluid to a downstream side of a fluid passage by rotation of an impeller provided in the fluid passage, includes: a reduced-diameter portion having a reduced inner diameter in a state of forming a reverse surface facing a downstream side, the reduced-diameter portion being provided at a portion located on an upstream side of the impeller in the fluid passage; and a reverse partition wall portion provided in the reverse surface and configured to restrict a flow of the fluid in a circumferential direction.

10 Claims, 15 Drawing Sheets

(56) References Cited

U.S. PATENT DOCUMENTS

| | | | | |
|---|---|---|---|---|
| 2018/0094647 | A1* | 4/2018 | Puzik | F04D 29/4206 |
| 2019/0264710 | A1 | 8/2019 | Mohtar et al. | |
| 2020/0208570 | A1* | 7/2020 | Bogner | F02B 37/225 |

FOREIGN PATENT DOCUMENTS

| | | | |
|---|---|---|---|
| JP | H07-208327 | A | 8/1995 |
| JP | 2010-14077 | A | 1/2010 |
| JP | 2018-513302 | A | 5/2018 |
| JP | 2019-19765 | A | 2/2019 |

* cited by examiner

TURBO TYPE PUMP AND FLUID SUPPLY UNIT

FIELD

The present disclosure relates to a turbo type pump configured to supply a fluid to a downstream side of a fluid passage by an impeller provided in the fluid passage, and a fluid supply unit including the turbo type pump.

In a turbo type pump including an impeller, under a situation in which a consumption flow rate on the downstream side is small with respect to a fluid-pressurizing-and-supplying capability, there is a concern that various problems may be caused due to generation of a swirling reverse flow in the fluid on the inlet side of the impeller. More specifically, even if the engine speed of the turbo type pump is constant, when an opening of a fluid discharge nozzle connected to the downstream side is narrowed, or when the discharge capability of a variable displacement pump connected to the downstream side is set to be small, the above-described reverse flow may occur. In addition, even when the consumption flow rate on the downstream side is constant, the above-described reverse flow may occur even when the engine speed of the turbo type pump on the upstream side increases (hereinafter, these operation states are simply collectively referred to as the time of excessive supply operation). For this reason, in the related art, there has been provided an orifice ring having a reverse surface so as to abut against a reverse-flowing fluid at a portion located upstream of the impeller, and a rectifying means for suppressing a swirling fluid is provided between the orifice ring and the impeller (for example, refer to Patent Literature 1).

CITATION LIST

Patent Literature

Patent Literature 1: Japanese Laic-open Patent Publication No. 2010-14077

SUMMARY

Technical Problem

However, the fluid after passing through the rectifying means also diffuses in the circumferential direction when abutting on the reverse surface of the orifice ring. Therefore, the reverse flow of the fluid cannot be efficiently reversed by the orifice ring, and there is still room for improvement in consideration of the pressurizing-and-supplying performance of the fluid at the time of excessive supply operation. Note that the above-described problem is not necessarily limited to one including an inducer, and can similarly occur as long as the fluid is pressurized and supplied downstream by rotation of the impeller.

In view of the above circumstances, an object of the present disclosure is to provide a turbo type pump and a fluid supply unit capable of improving pressurizing-and-supplying performance of a fluid at the time of excessive supply operation.

Solution to Problem

To attain the above object, a turbo type pump that pressurizes a fluid and supplies the fluid to a downstream side of a fluid passage by rotation of an impeller provided in the fluid passage, includes: a reduced-diameter portion having a reduced inner diameter in a state of forming a reverse surface facing a downstream side, the reduced-diameter portion being provided at a portion located on an upstream side of the impeller in the fluid passage; and a reverse partition wall portion provided in the reverse surface and configured to restrict a flow of the fluid in a circumferential direction.

According to the present disclosure, due to the reverse partition wall provided on the reverse surface, the fluid contacting the reverse surface is guided to the center side of the fluid passage without being diffusing in the circumferential direction. As a result, if a reverse flow is generated, it is possible to effectively reverse the flow, thus it is possible to improve pressurizing-and-supplying performance of a fluid at the time of an excessive supply operation in which the consumption flow rate on the downstream side is small with respect to fluid-pressurizing-and-supplying capability of an impeller.

Hereinafter, preferred embodiments of a turbo type pump and a fluid supply unit according to the present disclosure will be described in detail with reference to the accompanying drawings.

First Embodiment

Figure 1:
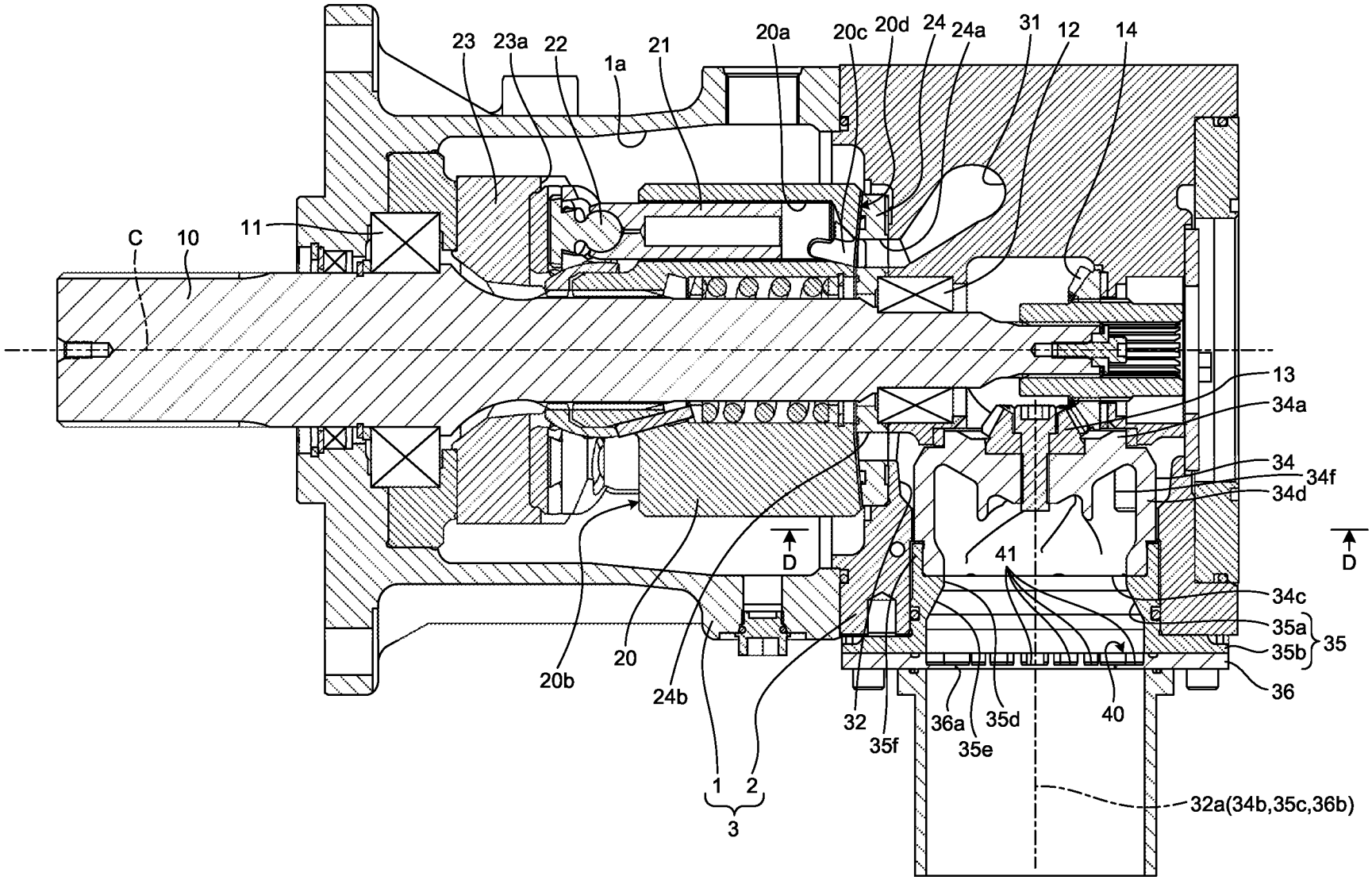
FIG. 1 is a cross-sectional side view of a fluid supply unit including a turbo type pump according to a first embodiment of the present disclosure.
Figure 2:
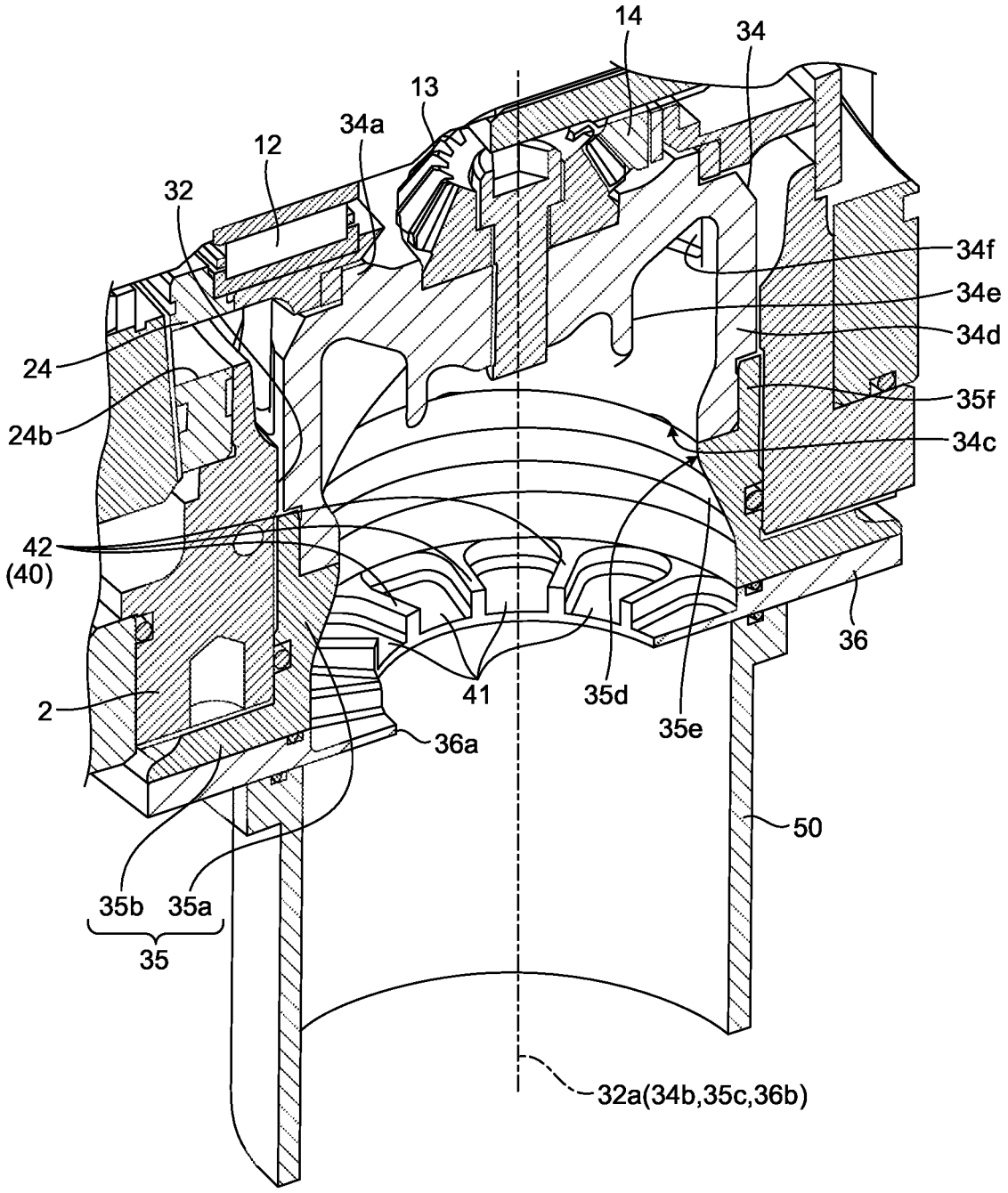
FIG. 2 is a cross-sectional perspective view illustrating a main part of the fluid supply unit illustrated in FIG. 1.
Figure 3A:
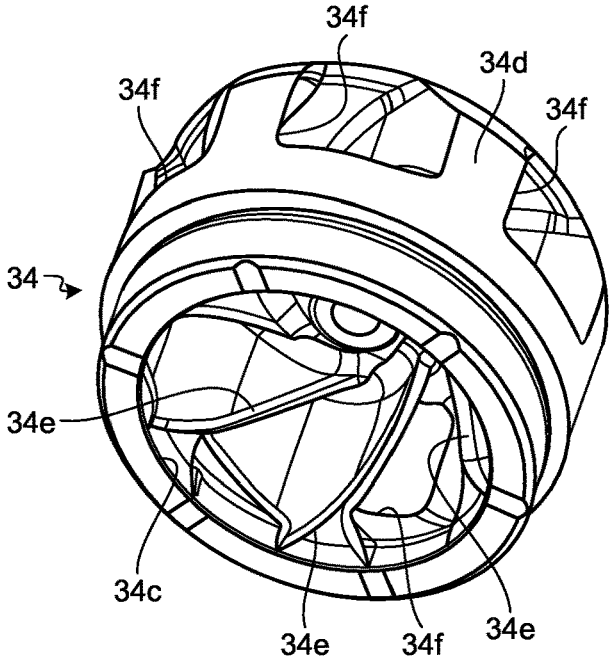
FIG. 3A is an external perspective view illustrating an impeller applied to the turbo type pump of the fluid supply unit illustrated in FIG. 1.
Figure 3B:
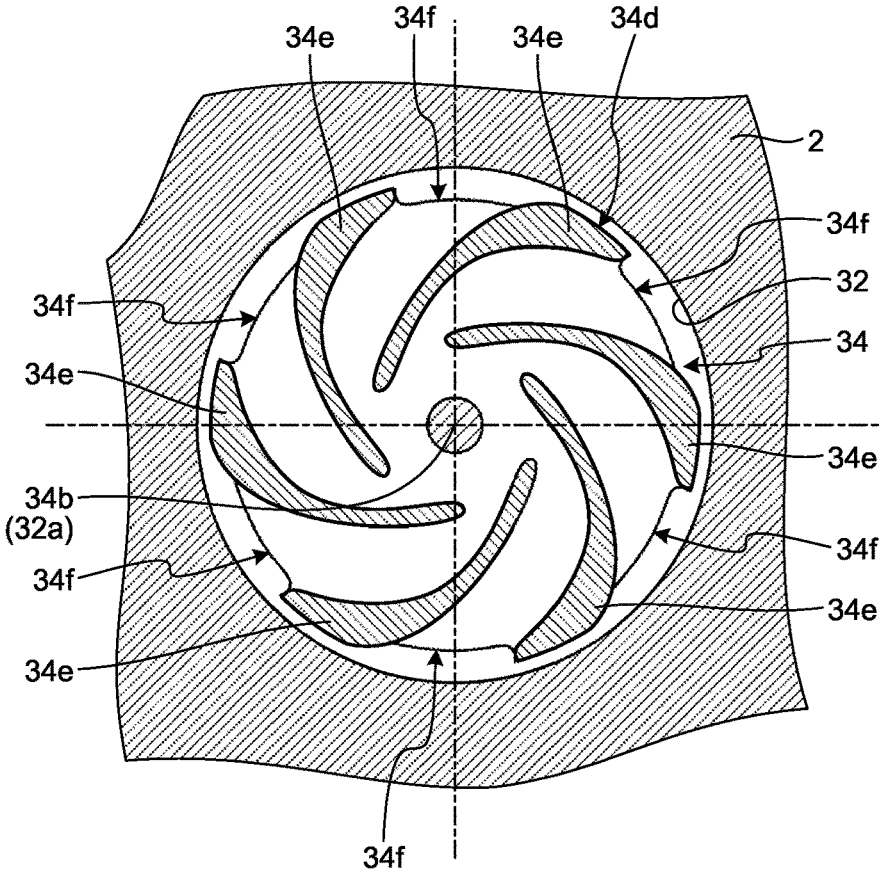
FIG. 3B is a cross-sectional view taken along line D-D in FIG. 1.
Figure 4:
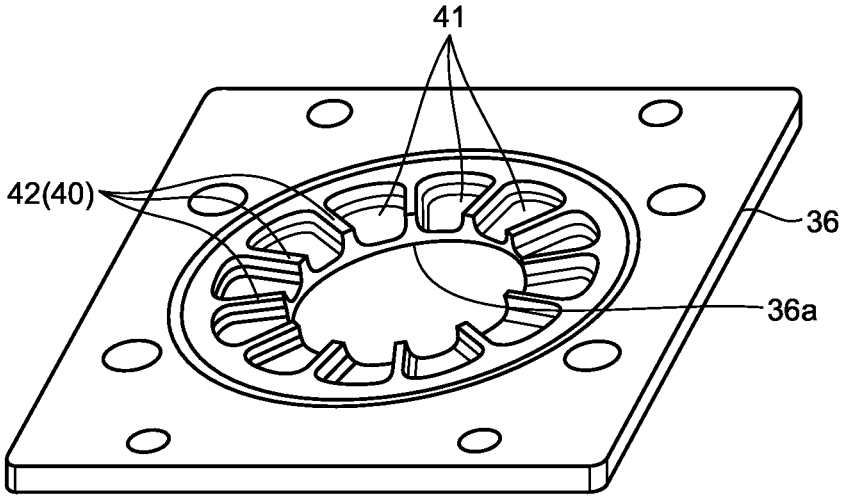
FIG. 4 is an external perspective view of an orifice plate for forming a reduced-diameter portion in the turbo type pump of the fluid supply unit illustrated in FIG. 1 as viewed from a reverse surface side facing the impeller.
Figure 5A:
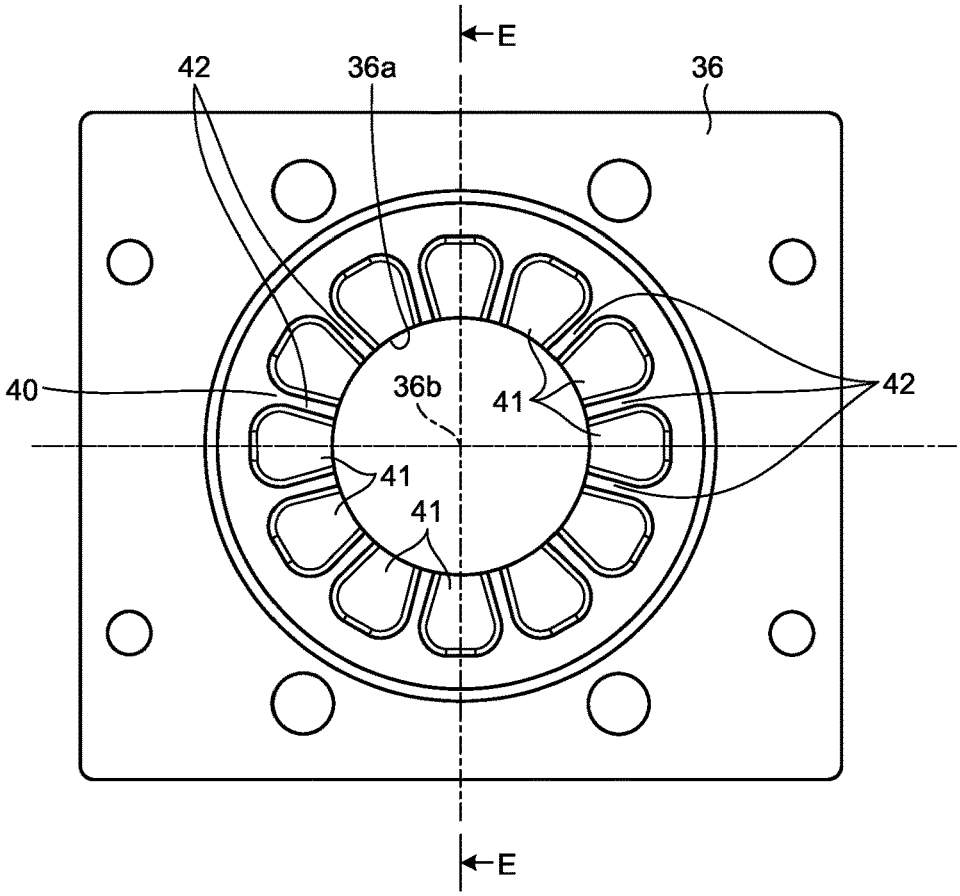
FIG. 5A illustrates the orifice plate illustrated in FIG. 4, and is a view as viewed from the reverse surface side facing the impeller.
Figure 5B:
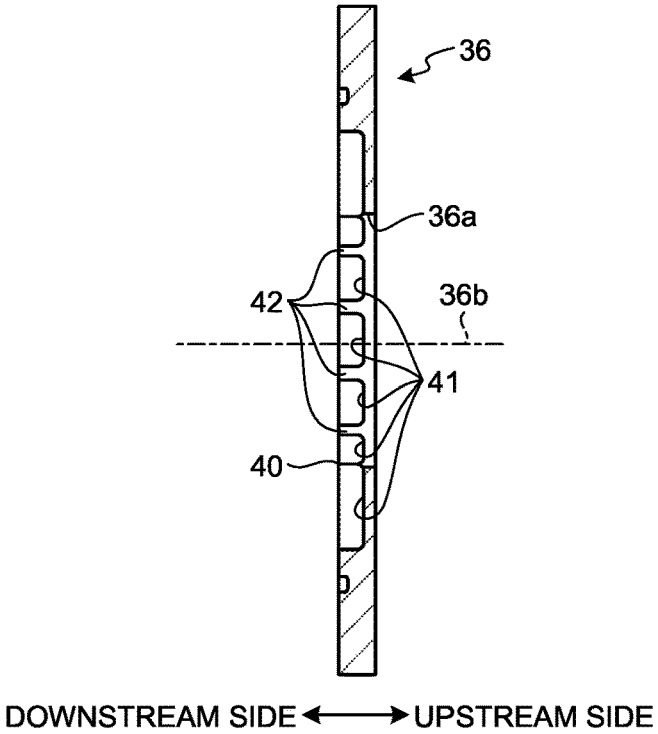
FIG. 5B is a cross-sectional view taken along line E-E in FIG. 5A.

FIGS. 1 and 2 illustrate a fluid supply unit including a turbo type pump according to a first embodiment of the present disclosure. The fluid supply unit exemplified here is a hydraulic pump unit for supplying oil to various hydraulic devices in a work machine, and includes an input shaft 10 inside a unit main body 3 formed by a case 1 and a port block 2. While one end portion of the input shaft 10 is exposed to the outside of the case 1, the other end portion thereof is supported by the unit main body 3 via bearings 11 and 12 in a state of being accommodated in the port block 2, and the input shaft 10 can rotate about an axis C. Although not clearly illustrated in the drawing, a drive source such as an engine or an electric motor mounted on the work machine is connected to the one end portion of the input shaft 10.

A cylinder block 20 is disposed in a hollow portion 1*a* formed in the case 1 in the unit main body 3. The cylinder block 20 forms a variable displacement type swash plate piston pump which is a positive displacement pump, and is disposed in the hollow portion 1*a* of the unit main body 3 via the input shaft 10 penetrating the center portion thereof. The cylinder block 20 is connected to the input shaft 10 by a spline, and can rotate with the input shaft 10 about the axis C as a rotation axis.

The cylinder block 20 is provided with a plurality of cylinder bores 20*a* around the input shaft 10. The cylinder bores 20*a* are cylindrical cavities respectively formed so as to be parallel to the axis C of the input shaft 10, and are disposed at equal intervals in the circumferential direction. Each of the cylinder bores 20*a* has one end portion opened to one end surface (hereinafter, referred to as an open side end surface 20*b*) of the cylinder block 20 and the other end portion opened to the other end surface (hereinafter, referred to as a sliding end surface 20*d*) of the cylinder block 20 via a small-diameter cylinder port 20*c*. A piston 21 is disposed in each of the cylinder bores 20*a*. The piston 21 is fitted so as to be movable along the axis of the cylinder bore 20*a*. Each piston 21 has a piston shoe 22 attached to an end portion thereof formed to protrude from the open side end surface 20*b* of the cylinder block 20. The piston shoe 22 is tiltably connected to the piston 21. One end portion of the cylinder block 20 is in slidable contact with a swash plate 23 via the piston shoe 22, and the other end portion thereof is in slidable contact with a valve plate 24 provided in the port block 2.

The swash plate 23 has a sliding contact surface 23*a* inclined with respect to the input shaft 10, and is in contact with the piston shoe 22 via the sliding contact surface 23*a*. The piston 21 in contact with the sliding contact surface 23*a* of the swash plate 23 via the piston shoe 22 reciprocates inside the cylinder bore 20*a* in accordance with inclination of the sliding contact surface 23*a* when the cylinder block 20 rotates. Although not clearly illustrated in the drawing, in the hydraulic pump unit exemplified in the first embodiment, the inclination angle of the sliding contact surface 23*a* with respect to the input shaft 10 can be changed. When the inclination angle of the sliding contact surface 23*a* is changed, a reciprocating movement distance of the piston 21 with respect to the cylinder bore 20*a* when the cylinder block 20 rotates changes.

The valve plate 24 has a circular shape having inner and outer diameters capable of simultaneously closing all the cylinder ports 20*c* opened to the sliding end surface 20*d* of the cylinder block 20. In the first embodiment, the sliding end surface 20*d* of the cylinder block 20 is formed to be a concave spherical surface, and a portion of the valve plate 24 facing the sliding end surface 20*d* of the cylinder block 20 is formed to be a convex spherical surface so as to be in sliding contact with the concave spherical surface without a gap therebetween.

In the valve plate 24, a high pressure port 24*a* and a low pressure port 24*b* are provided on the circumference around the axis C of the input shaft 10. The high pressure port 24*a* and the low pressure port 24*b* are notches formed to penetrate the valve plate 24, and the same extend in an arc shape so that the plurality of cylinder ports 20*c* adjacent thereto can communicate with each other.

On the other hand, the port block 2 of the unit main body 3 is provided with a discharge passage 31 and a suction passage (fluid passage) 32. One end of the discharge passage 31 communicates with the high pressure port 24*a* of the valve plate 24, and the other end thereof (not illustrated) opens to the outer surface of the port block 2. An oil passage (not illustrated) for supplying oil to various hydraulic devices is connected to an opening end portion of the discharge passage 31 opened to the outer surface of the port block 2. The suction passage 32 linearly extends in the radial direction from a portion close to the axis C of the input shaft 10, and the same has one end communicating with the low pressure port 24*b* of the valve plate 24 and the other end thereof opened to the outer surface of the port block 2. As is clear from the drawing, the suction passage 32 is configured to have a larger inner diameter than that of the discharge passage 31, and includes an impeller 34 and a sleeve 35 provided therein and an orifice plate 36 provided at an opening end portion thereof. The impeller 34, the sleeve 35, and the orifice plate 36 form a turbo type pump which is a non-positive displacement pump in front of the variable displacement type swash plate piston pump described above.

As illustrated in FIGS. 1 to 3B, the impeller 34 has a support shaft portion 34*a* at a proximal end portion thereof, and is rotatably disposed in the port block 2 via the support shaft portion 34*a* in a state where an axis 34*b* (rotation axis) of the support shaft portion 34*a* matches an axis 32*a* of the suction passage 32. The impeller 34 is provided with a cylindrical portion 34*d* having an introduction port 34*c* opened upstream of the suction passage 32. Inside the cylindrical portion 34*d*, a plurality of blade portions 34*e* are formed in a curved shape in the radial direction. In the cylindrical portion 34*d*, a plurality of discharge ports 34*f* are provided at portions between the blade portions 34*e* so as to be opened to the outer peripheral surface.

A driven gear 13 is provided at a proximal end portion of the impeller 34. The driven gear 13 is a bevel gear attached so that its axis coincides with the axis 34*b* of the support shaft portion 34*a*, and is meshed with a drive gear 14 provided on the input shaft 10. The drive gear 14 is a bevel gear attached so that its axis coincides with the axis C of the input shaft 10, and functions so as to rotate the impeller 34 at an increasing speed through the driven gear 13 when the input shaft 10 rotates. The impeller 34 is interlocked with the drive gear 14 and the driven gear 13 at an accelerating ratio when the input shaft 10 rotates, and the same has a function of suctioning the oil in the suction passage 32 from the introduction port 34*c* by the plurality of blade portions 34*e* and discharging the suctioned oil from the discharge port 34*f* of the outer peripheral portion to pressurize and supply the suctioned oil to the low pressure port 24*b* of the valve plate 24. This pressurization force increases in proportion to the square of the engine speed of the impeller 34.

As illustrated in FIGS. 1 and 2, the sleeve 35 is attached to a portion located upstream of the impeller 34 on the inner peripheral surface of the suction passage 32, thereby having a function of guiding the rotation of the impeller 34 and guiding the flow of oil to the introduction port 34*c*. In the first embodiment, the sleeve 35 having a sleeve main body 35*a* and a flange portion 35*b* is applied. The sleeve main body 35*a* has a circular cross section and a linear axis 35*c*, and is formed to have an outer diameter that can be fitted into the suction passage 32. The flange portion 35*b* has a flat plate shape formed to extend from one end portion of the sleeve main body 35*a* toward the outer periphery. The sleeve 35 is fixed to the port block 2 by screwing a screw into the port block 2 via the flange portion 35*b* in a state where the sleeve main body 35*a* is inserted into the suction passage 32 and the flange portion is in contact with the outer surface of the port block 2.

On the inner peripheral surface of the sleeve main body 35*a*, a downstream end portion 35*d* communicating with the introduction port 34*c* of the impeller 34 has substantially the same inner diameter as that of the introduction port 34*c*, and has a tapered portion 35*e*, the inner diameter of which gradually increases toward the upstream side. An outer cylindrical portion 35*f* slidably fitted to the outer peripheral portion of the end portion of the cylindrical portion 34*d* of the impeller 34 is provided at the end portion located on the most downstream in the sleeve main body 35*a*.

As illustrated in FIGS. 1, 2, 4, 5A, and 5B, the orifice plate 36 has a flat plate shape having an orifice hole (reduced-diameter portion) 36*a* at the center portion, and is attached to the port block 2 in a state where an axis 36*b* of the orifice hole 36*a* coincides with the axis of the sleeve main body 35*a*. The orifice hole 36*a* is formed to have an inner diameter smaller than that of the upstream end portion of the sleeve main body 35*a*. As a result, when the orifice plate 36 is attached to the port block 2, the orifice plate 36 protrudes to the inner peripheral side of the sleeve main body 35*a* and forms a reverse surface 40 with the sleeve main body 35*a*. That is, in the suction passage 32 in a state where the orifice plate 36 and the sleeve 35 are attached, the inner diameter temporarily increases on the upstream side of the sleeve main body 35*a* after passing through the orifice hole 36*a*, and the inner diameter gradually decreases until reaching the impeller 34. In the first embodiment, the orifice hole 36*a* is formed in the orifice plate 36 so as to have an inner diameter smaller than that of the introduction port 34*c* of the impeller 34.

The reverse surface 40 faces the downstream side extending so as to be orthogonal to the axis 32*a* of the suction passage 32. On the reverse surface 40, a plurality of reverse concave surfaces 41 are provided at equal intervals in the circumferential direction at a portion around the orifice hole 36*a*. The reverse concave surface 41 is a recess formed so that the inner bottom surface is flat and parallel to the reverse surface 40, and each outer peripheral end substantially coincides with the inner peripheral surface of the upstream end portion of the sleeve main body 35*a*. The reverse concave surfaces 41 adjacent to each other in the circumferential direction are isolated from each other by a reverse partition wall portion 42 configured by securing a space therebetween. The reverse partition wall portion 42 is a portion where the reverse surface 40 is exposed, extends radially in the radial direction with respect to the axis 36*b* of the orifice hole 36*a*, and is configured to open only in the orifice hole 36*a*.

As illustrated in FIGS. 1 and 2, a suction pipe 50 is connected to the suction passage 32 via the orifice plate 36. The suction pipe 50 is connected to an oil tank (not illustrated). In the first embodiment, the suction pipe 50 having an inner diameter larger than that of the orifice hole 36*a* and substantially coinciding with the inner peripheral surface of the upstream end portion of the sleeve main body 35*a* is connected.

In the hydraulic pump unit configured as described above, when the input shaft 10 rotates by rotation of a drive source (not illustrated), the piston 21 reciprocates with rotation of the cylinder block 20. As a result, the oil suctioned into the cylinder bore 20*a* through the suction pipe 50, the orifice hole 36*a*, the sleeve main body 35*a*, the impeller 34, and the low pressure port 24*b* of the valve plate 24 is supplied to various hydraulic devices through the high pressure port 24*a* of the valve plate 24, the discharge passage 31, and an oil passage (not illustrated).

During this time, in the suction passage 32, the impeller 34 that rotates at an increasing speed via the drive gear 14 and the driven gear 13 has a function of increasing the pressure of the oil from the suction pipe 50 to the low pressure port 24*b* of the valve plate 24, thereby making it possible to improve pump suction performance in the variable displacement type swash plate piston pump.

Here, under a situation where the consumption flow rate on the downstream side is small with respect to the fluid-pressurizing-and-supplying capability of the impeller 34 (hereinafter, simply referred to as the time of excessive supply operation), such as a case in which the input shaft 10 rotates at a speed higher than the rated engine speed due to rotational fluctuation of a drive source, a case in which the swash plate 23 of a variable displacement type swash plate piston pump is set to a small inclination angle, and the like, the pressure of the suction passage 32 increases, and the oil that has passed through the discharge port 34*f* of the impeller 34 flows back to the sleeve main body 35*a* in a swirling manner through the discharge port 34*f* again, which may cause generation of surging. In addition, when a swirling reverse flow develops in the sleeve main body 35*a* and the suction pipe 50, cavitation occurs in the reverse flow due to a pressure drop in the center portion (hereinafter, simply referred to as reverse flow vortex cavitation), which may cause a situation in which stable operation becomes difficult.

However, according to the above-described hydraulic pump unit, the reverse flow generated in the sleeve main body 35*a* is reversed by abutting on the orifice plate 36, and there is no possibility of causing the above-described problem. That is, the reverse flow of swirling oil generated in the sleeve main body 35*a* at the time of excessive supply operation is smoothly introduced into the tapered portion 35*e* by centrifugal force and abuts on the orifice plate 36 to be reversed. The oil reversed by the orifice plate 36 joins the oil flowing into the orifice hole 36*a* from the suction pipe 50 and accelerates the flow toward the introduction port 34*c* of the downstream impeller 34. Therefore, even at the time of excessive supply operation, it is possible to prevent problems such as generation of surging and unstable operation due to generation of the reverse flow vortex cavitation.

In particular, in the first embodiment, since the reverse concave surface 41 and the reverse partition wall portion 42 are provided on the reverse surface 40 of the orifice plate 36, the situation in which the oil abutting on the reverse concave surface 41 is diffused in the circumferential direction by the reverse partition wall portion 42 is limited, and the oil is supplied toward the orifice hole 36*a*. As a result, the reverse flow of the oil introduced into the tapered portion 35*e* of the sleeve main body 35*a* is efficiently reversed in the orifice plate 36, and it is possible to improve the pressurizing-and-supplying performance of the oil by the impeller 34 and the pump suction performance of the variable displacement type swash plate piston pump at the time of excessive supply operation.

Figure 6:
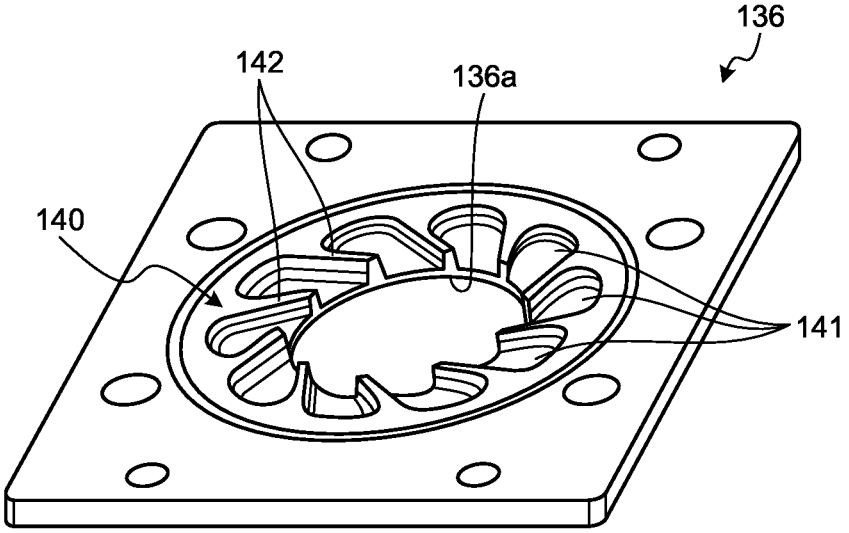
FIG. 6 is an external perspective view of a modification of the orifice plate as viewed from the reverse surface side facing the impeller.
Figure 7A:
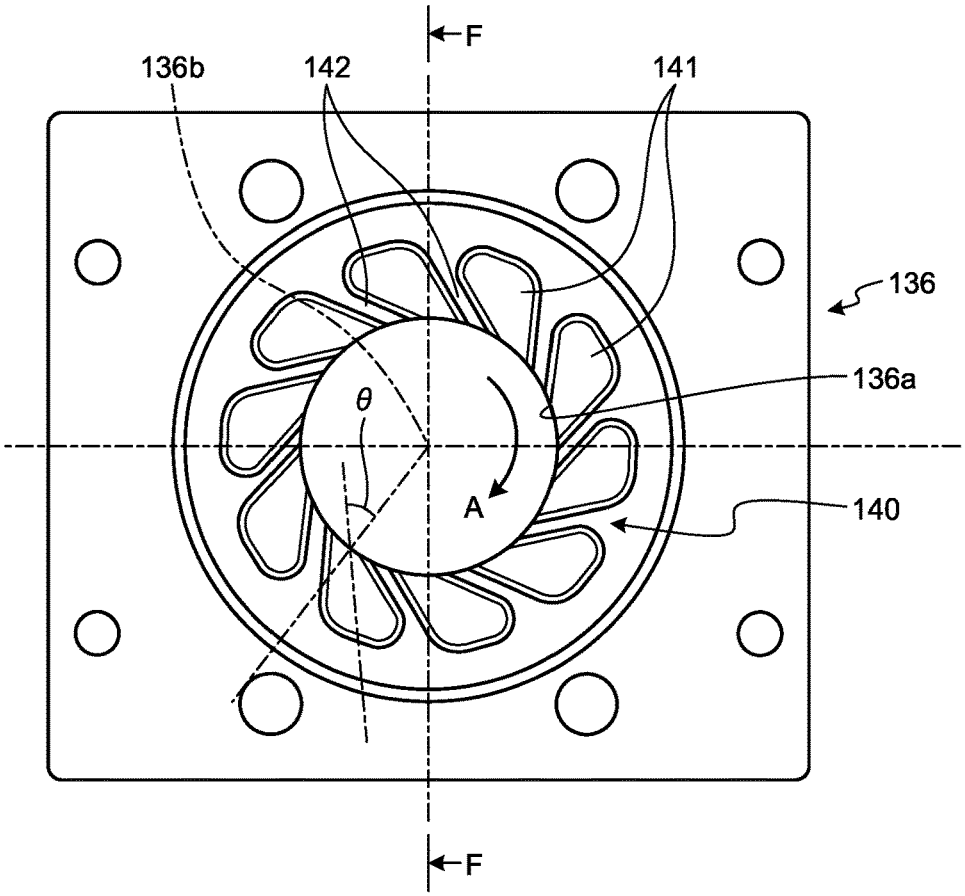
FIG. 7A illustrates a modification of the orifice plate illustrated in FIG. 6, and is a view viewed from the reverse surface side facing the impeller.
Figure 7B:
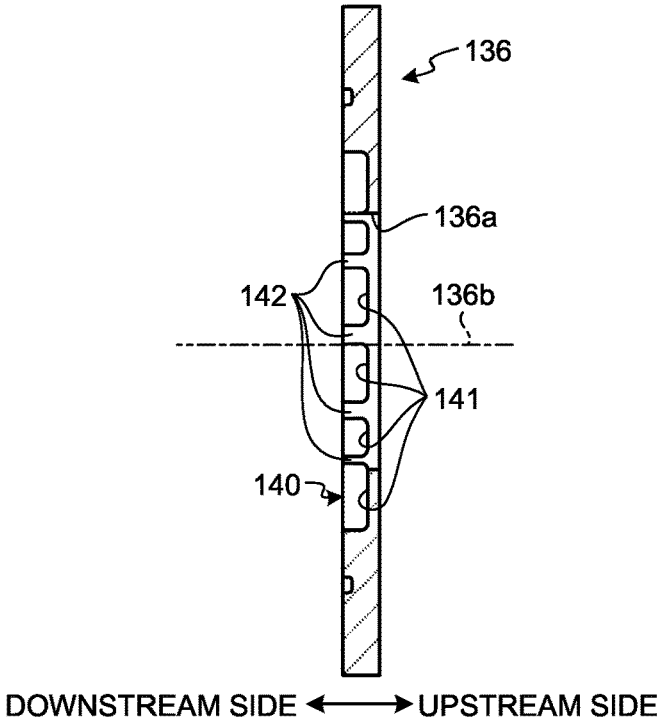
FIG. 7B is a cross-sectional view taken along line F-F in FIG. 7A.

In the first embodiment described above, the reverse partition wall portions 42 of the orifice plate 36 are radially provided, but the present disclosure is not limited thereto. For example, as in an orifice plate 136 of a modification illustrated in FIGS. 6, 7A, and 7B, a reverse partition wall portion 142 may be provided so as to be inclined (angle: θ) in the rotation direction (arrow A) of the impeller 34 from the outer peripheral side toward the inner peripheral side with respect to the radius passing through an axis 136*b* of the orifice hole (reduced-diameter portion) 136*a* (refer to FIG. 7A). That is, the reverse flow of oil generated in the sleeve main body 35*a* is swirled in the same direction as the rotation direction A of the impeller 34. Therefore, by providing the reverse partition wall portion 142 so as to extend in the swirling direction of the reverse flow, when the oil abuts on a reverse concave surface 141, the flow of the oil toward the center side facing the orifice hole 136*a* becomes smooth, and it can be expected that the above-described action and effect become more remarkable. The orifice plate 136 of this modification is configured on the premise that the same is applied instead of the orifice plate 36 of the hydraulic pump unit exemplified in the first embodiment. In addition, the reverse concave surface 141 is provided on a reverse surface 140 of the orifice plate 136 at equal intervals in the circumferential direction, and is formed so that the inner bottom surface is flat and parallel to the reverse surface 140, which is the same as the first embodiment.

In addition, in the first embodiment and the modification described above, the reverse concave surface having a flat inner bottom surface is exemplified, but the present disclosure is not limited thereto, and a reverse concave surface having a curved inner bottom surface may be provided as in a second embodiment described below.

Second Embodiment

Figure 8:
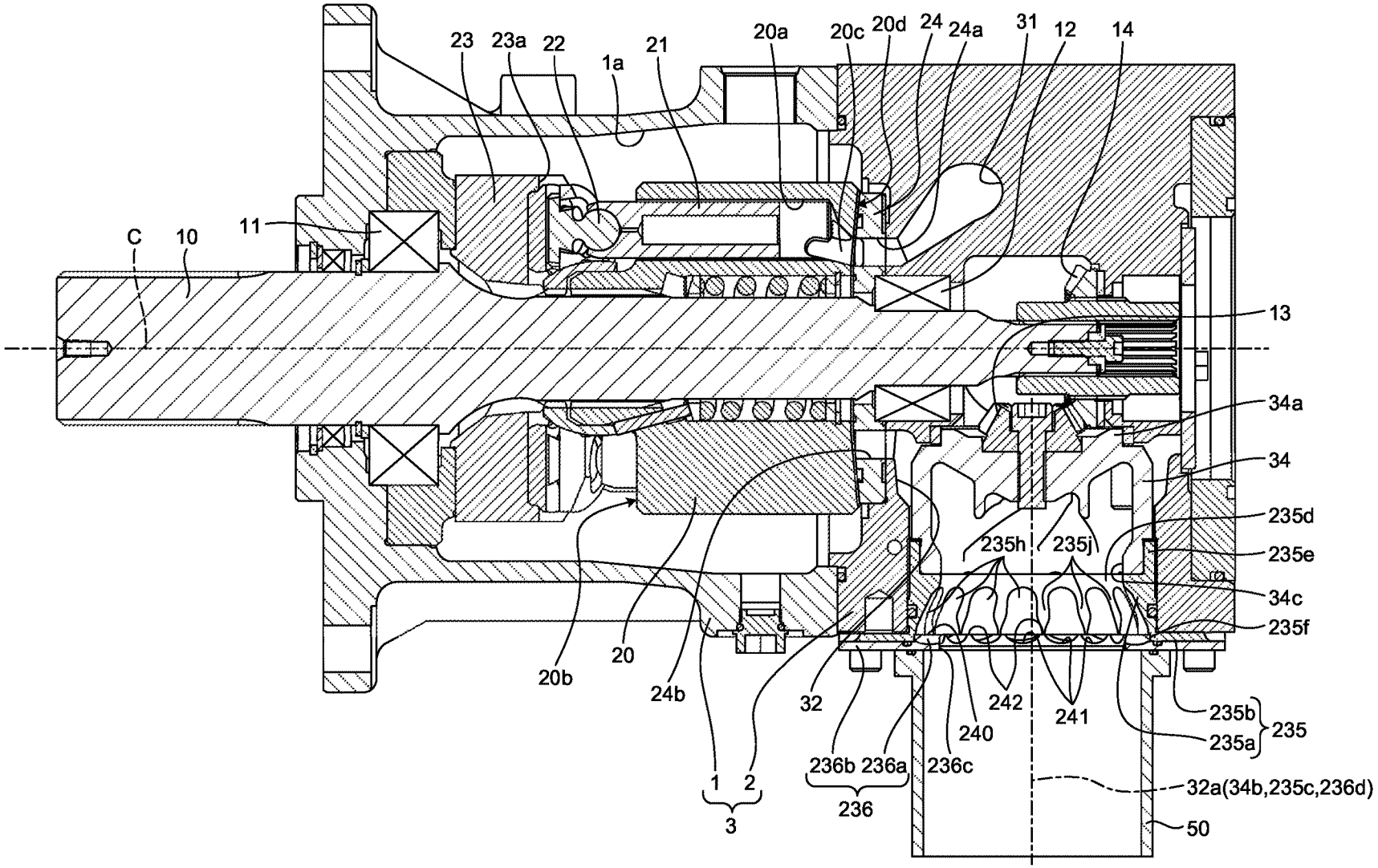
FIG. 8 is a cross-sectional side view of a fluid supply unit including a turbo type pump according to a second embodiment of the present disclosure.
Figure 9:
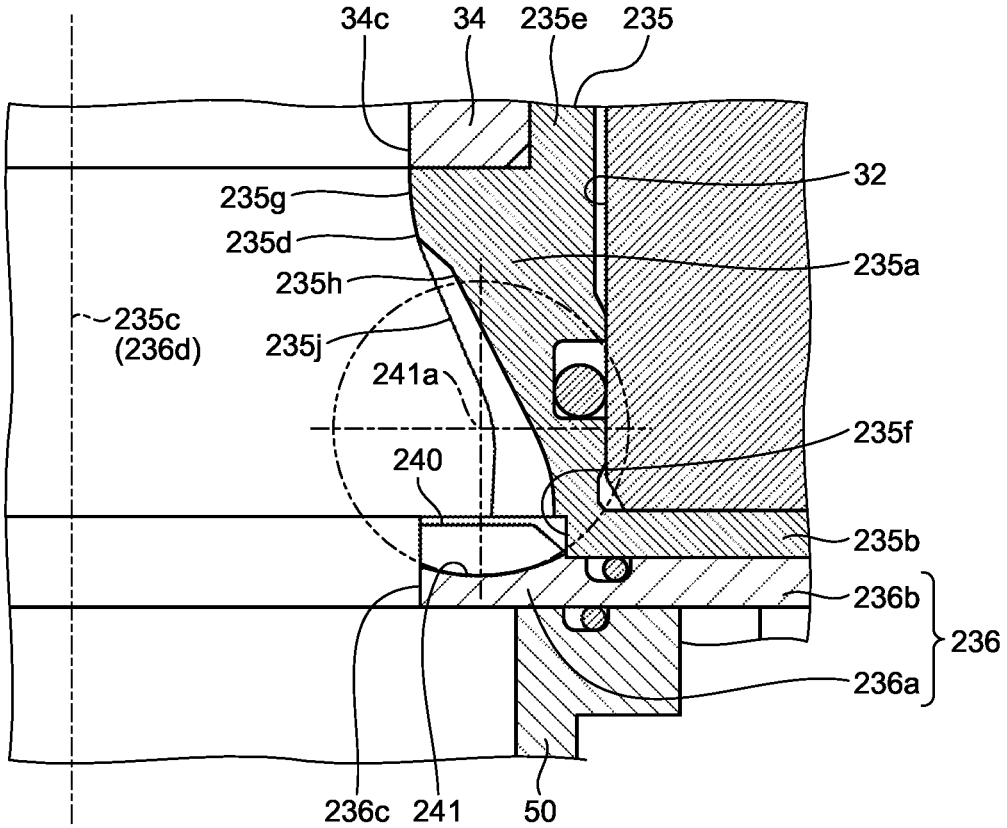
FIG. 9 is an enlarged cross-sectional view of a main part of the fluid supply unit illustrated in FIG. 8.
Figure 10:
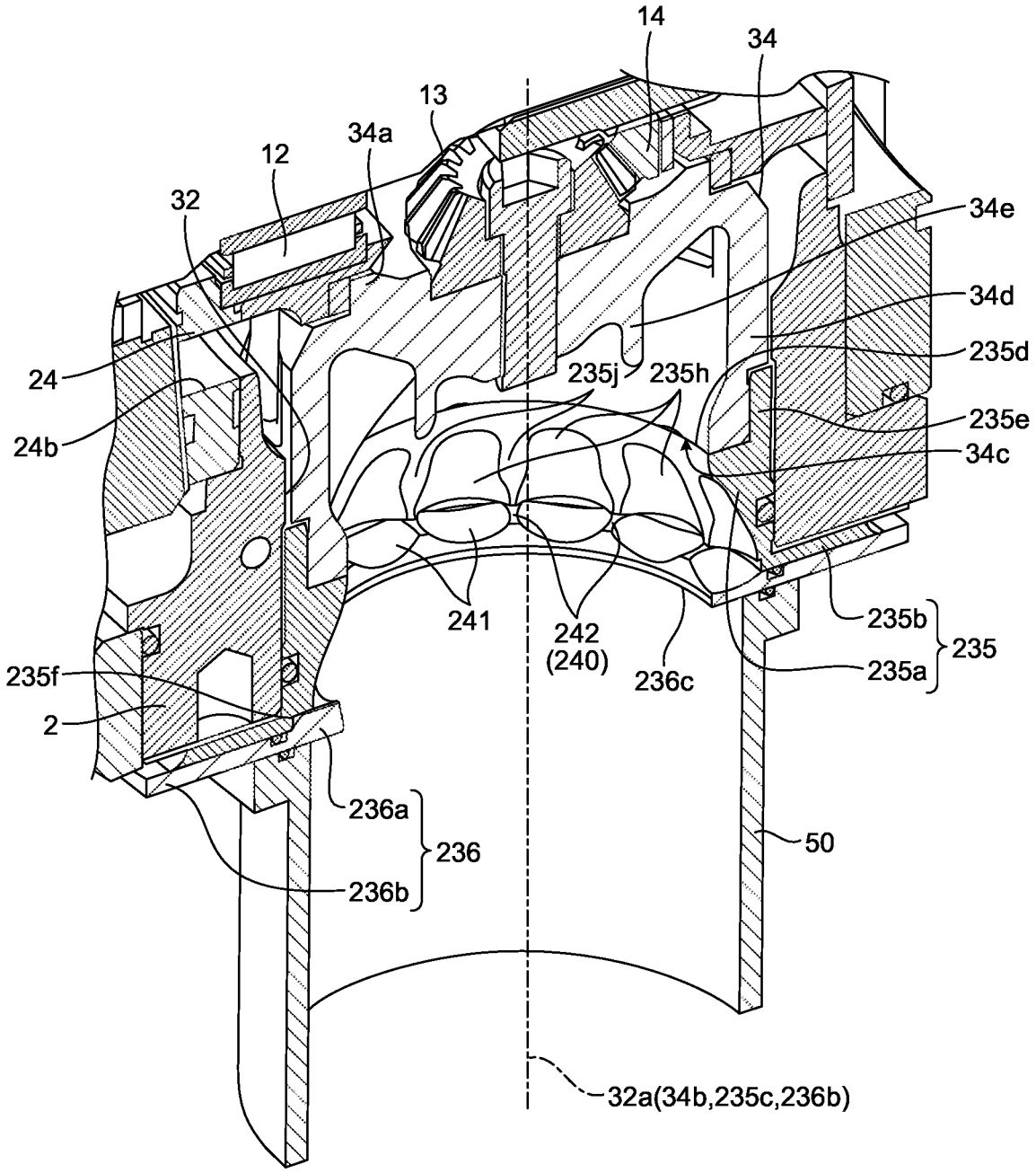
FIG. 10 is a cross-sectional perspective view illustrating a main part of the fluid supply unit illustrated in FIG. 8.
Figure 11A:
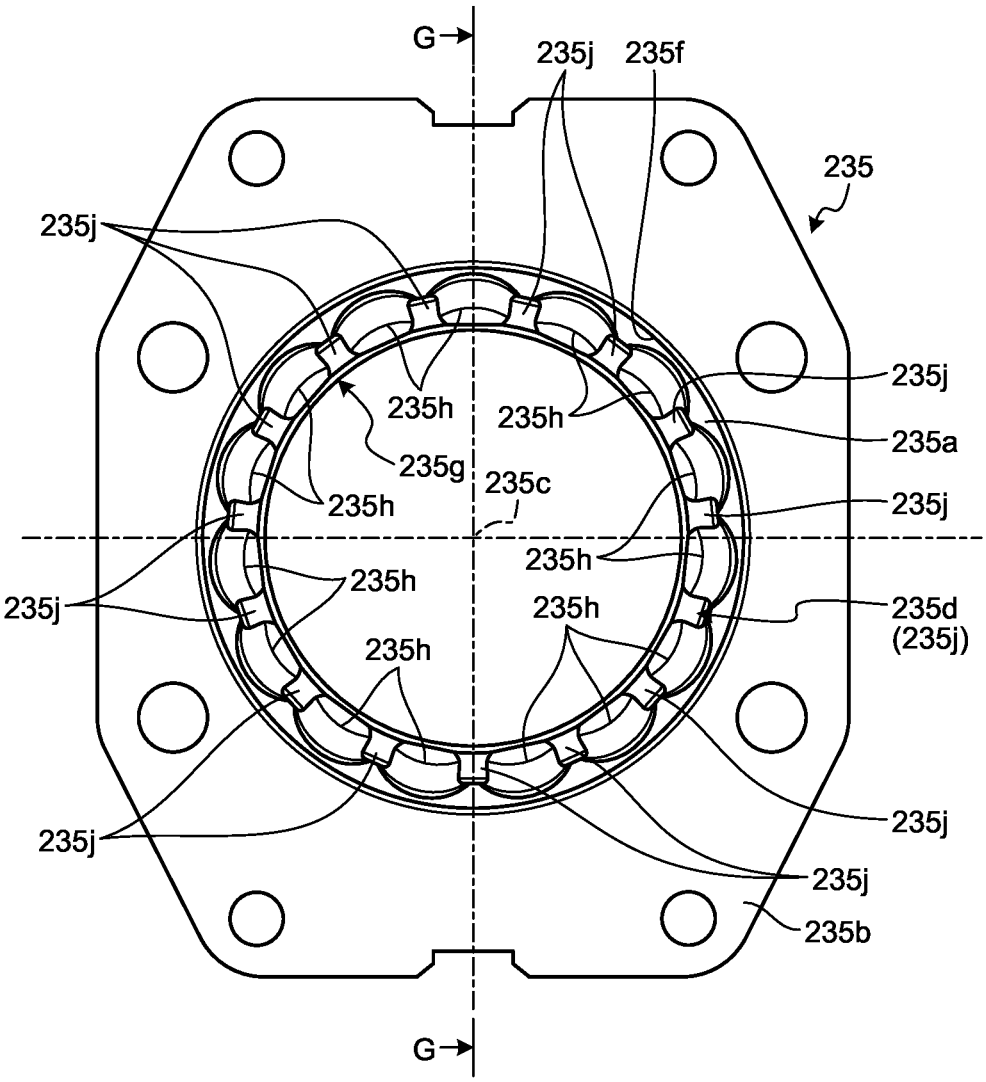
FIG. 11A illustrates a sleeve for forming a fluid passage in the turbo type pump of the fluid supply unit illustrated in FIG. 8, and is a view as viewed from the upstream end surface toward the downstream side.
Figure 11B:
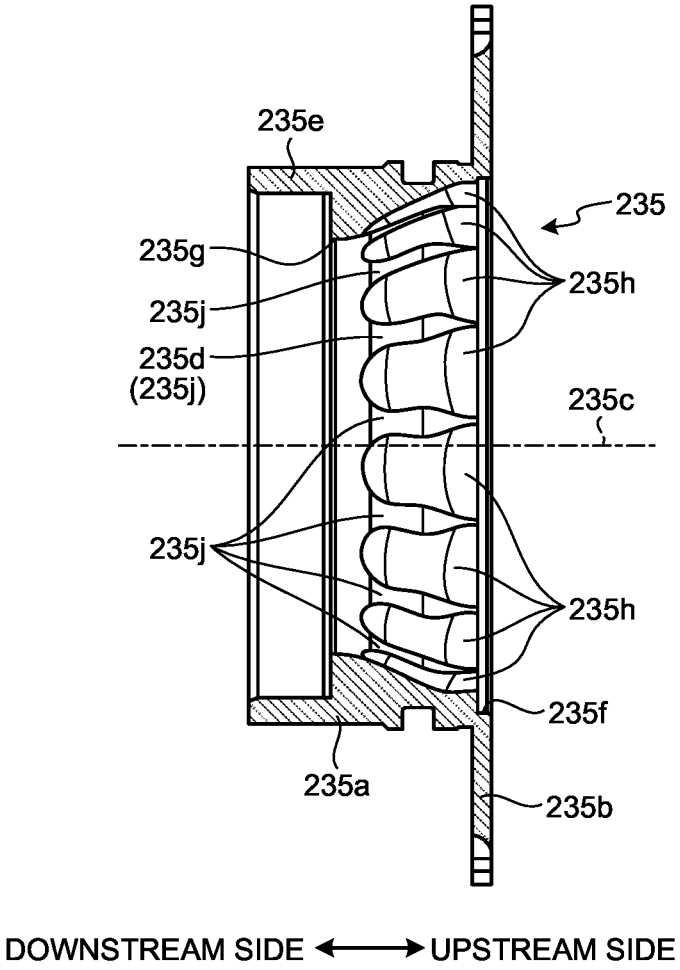
FIG. 11B is a cross-sectional view taken along line G-G in FIG. 11A.
Figure 12:
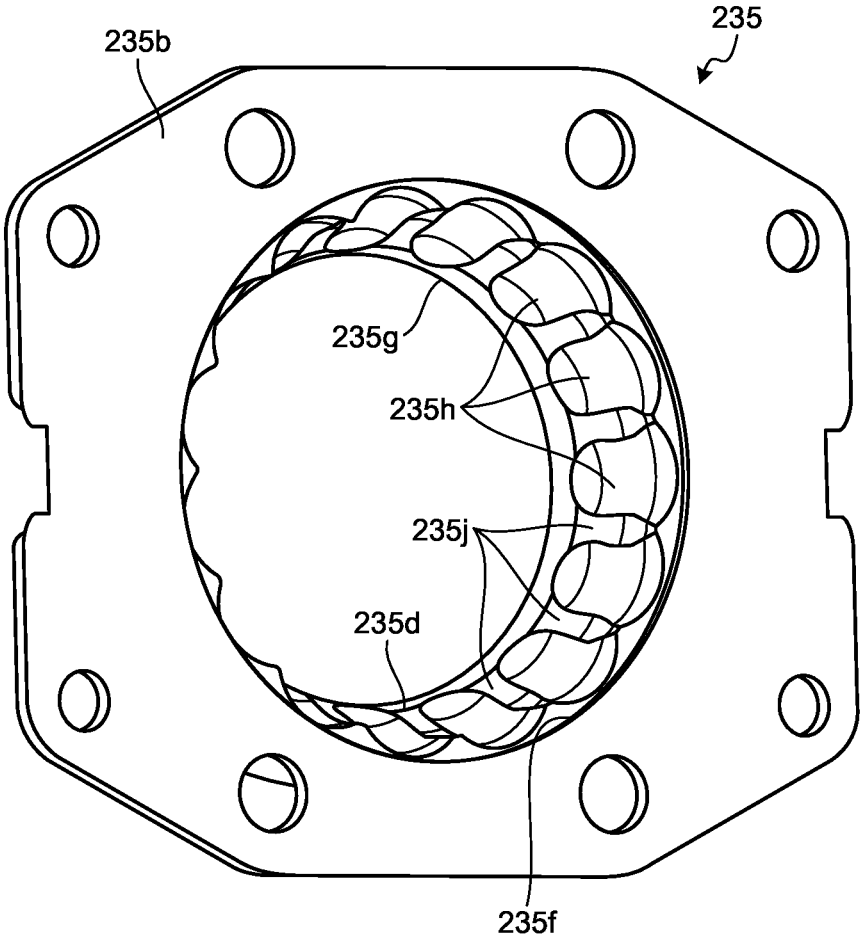
FIG. 12 is an external perspective view of the sleeve illustrated in FIG. 8 as viewed from the upstream end surface toward the downstream side.
Figure 13A:
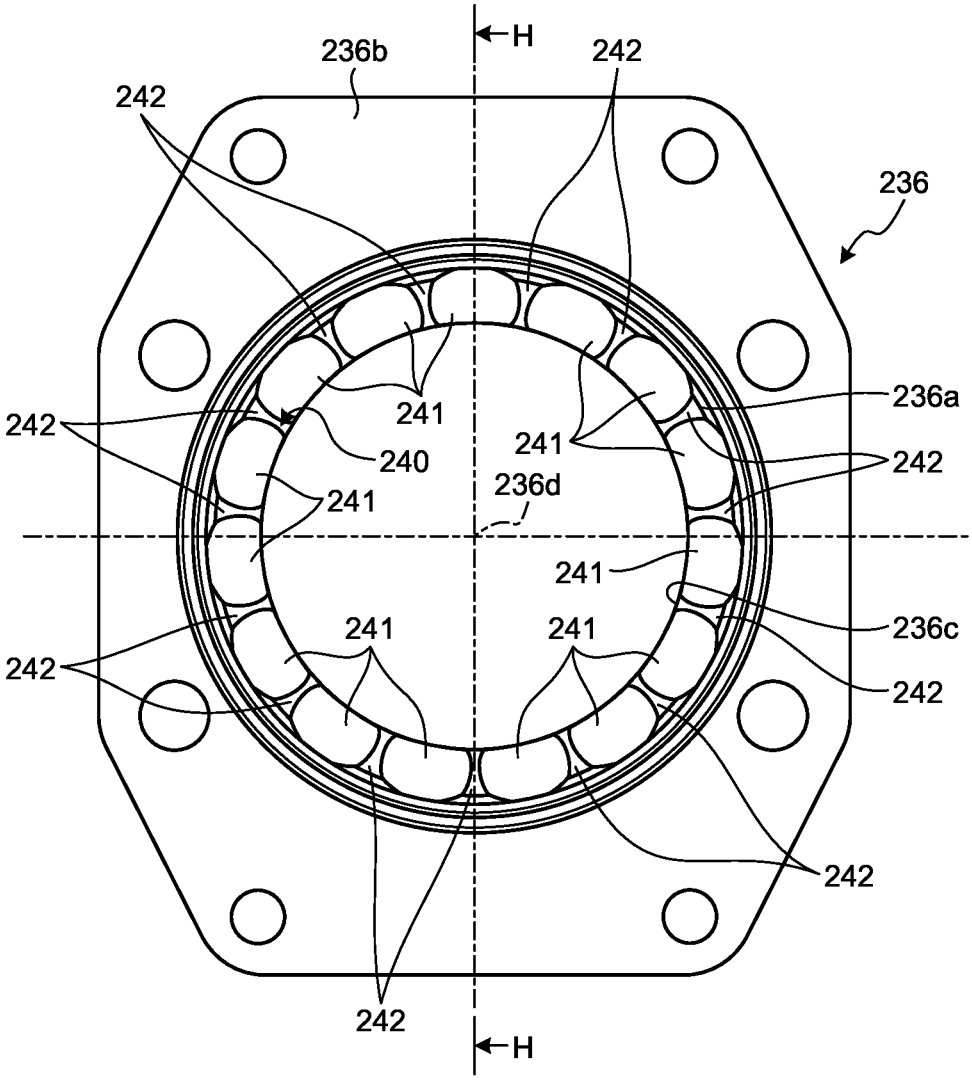
FIG. 13A illustrates an orifice plate for forming a reduced-diameter portion in the turbo type pump of the fluid supply unit illustrated in FIG. 8, and is a view as viewed from the reverse surface side facing the impeller.
Figure 13B:
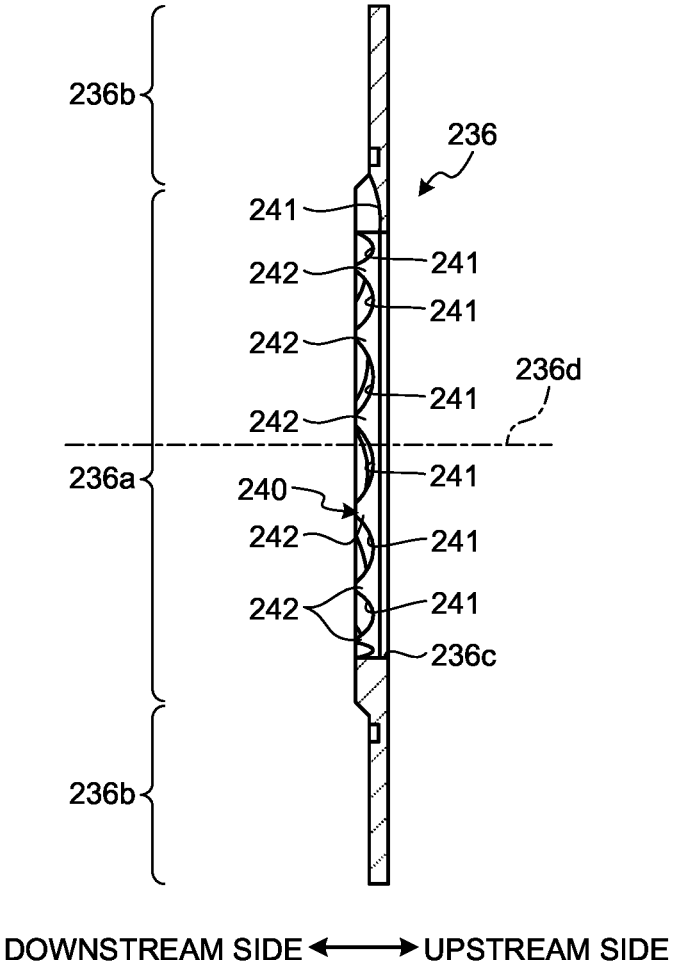
FIG. 13B is a cross-sectional view taken along line H-H in FIG. 13A.

FIGS. 8 to 10 illustrate a fluid supply unit including a turbo type pump according to a second embodiment. The fluid supply unit exemplified here is a hydraulic pump unit for supplying oil to various hydraulic devices in a work machine as in the first embodiment, and is mainly different from the first embodiment in configurations of a sleeve 235 and an orifice plate 236. Hereinafter, differences from the first embodiment will be mainly described, and common configurations will be denoted by the same reference numerals.

As shown in FIGS. 9 to 11B, the sleeve 235 is attached to a portion located upstream of the impeller 34 on the inner peripheral surface of the suction passage 32, thereby having a function of guiding the rotation of the impeller 34 and guiding the flow of oil to the introduction port 34*c*. In the second embodiment, the sleeve 235 having a sleeve main body 235*a* and a flange portion 235*b* is applied. As illustrated in FIGS. 8 to 12, the sleeve main body 235*a* has a circular cross section and a linear axis 235*c*, and is formed to have an outer diameter that can be fitted into the suction passage 32. The flange portion 235*b* has a flat plate shape formed to extend from one end portion of the sleeve main body 235*a* toward the outer periphery. The sleeve 235 is fixed to the port block 2 by screwing a screw into the port block 2 via the flange portion 235*b* in a state where the sleeve main body 235*a* is inserted into the suction passage 32 and the flange portion 235*b* is in contact with the outer surface of the port block 2.

An inner peripheral surface 235*d* of the sleeve main body 235*a* is configured so that the end portion positioned on the upstream side has an inner diameter larger than that of the introduction port 34*c* of the impeller 34, and has a tapered shape extending so that the inner diameter gradually decreases toward the downstream side. An outer cylindrical portion 235*e* slidably fitted to the outer peripheral portion of the impeller 34 is provided at the end portion located on the most downstream side in the sleeve main body 235*a*. A wide mouth portion 235*f* having an inner diameter larger than that of the inner peripheral surface is formed at the end portion located on the most upstream side in the sleeve main body 235*a*. On the inner peripheral surface 235*d* of the sleeve main body 235*a*, a downstream end portion 235*g* communicating with the introduction port 34*c* of the impeller 34 is formed to have substantially the same inner diameter as the introduction port 34*c*.

On the inner peripheral surface 235*d* of the sleeve main body 235*a*, a plurality of rectifying grooves 235*h* are disposed side by side at equal intervals in the circumferential direction. The rectifying groove 235*h* has a cylindrical concave shape, and is formed so that each axis extends linearly along the axis 235*c* of the sleeve main body 235*a*. More specifically, the rectifying groove 235*h* is provided with concave spherical surface portions above and below the cylindrical concave portion. In the sleeve main body 235*a*, a front-stage partition wall portion 235*j* is formed by securing a space between the rectifying grooves 235*h*. The front-stage partition wall portion 235*j* is a portion at which the inner peripheral surface 235*d* of the sleeve main body 235*a* is exposed, and linearly extends along the axis 235*c* of the sleeve main body 235*a*. As is clear from the drawing, the concave spherical surface portions of the upstream end portions of the rectifying grooves 235*h* communicate with each other in the wide mouth portion 235*f*. In the downstream end portion of the rectifying groove 235*h*, individual concave spherical surface portions individually terminate at positions spaced upstream from the downstream end portion 235*g* communicating with the introduction port 34*c* of the impeller 34.

As illustrated in FIGS. 9, 10, 13A, and 13B, since the orifice plate 236 has a disk-shaped thick plate portion 236*a* at the center portion and a thin plate portion 236*b* around the thick plate portion 236*a*, the thick plate portion 236*a* is inserted into the wide mouth portion 235*f* of the sleeve 235, and the thin plate portion 236*b* is attached to the port block 2 in a state of being superposed on the flange portion 235*b* of the sleeve 235. The orifice plate 236 is provided with an orifice hole (reduced-diameter portion) 236*c* at the center portion of the thick plate portion 236*a*. The orifice hole 236*c* is formed to have an inner diameter smaller than that of the upstream end portion of the sleeve main body 235*a*. As a result, when the orifice plate 236 is attached to the port block 2, the orifice plate 236 protrudes to the inner peripheral side of the sleeve main body 235*a* and forms a reverse surface 240 inside the sleeve main body 235*a*. That is, in the suction passage 32 in a state where the orifice plate 236 and the sleeve 235 are attached, the inner diameter temporarily increases in the sleeve main body 235*a* after passing through the orifice hole 236*c*, and the inner diameter gradually decreases until reaching the impeller 34. In the second embodiment, the orifice hole 236*c* is formed in the orifice plate 236 so as to have the same inner diameter as that of the introduction port 34*c* of the impeller 34.

The reverse surface 240 faces the downstream side extending so as to be orthogonal to the axis 32*a* of the suction passage 32. On the reverse surface 240, a plurality of reverse concave surfaces 241 are provided at equal intervals in the circumferential direction at a portion around the orifice hole 236*c*. The reverse concave surface 241 is formed in a spherical concave shape protruding toward the upstream side. As illustrated in FIG. 9, each of the reverse concave surfaces 241 has a portion in which a center 241*a* of the sphere, which is the center of curvature, is located between the orifice hole 236*c* and the wide mouth portion 235*f* and is gradually curved toward the downstream (upper side in FIG. 9) toward an axis 236*d* of the orifice hole 236*c*. As illustrated in FIGS. 9 to 11B, 13A, and 13B, in the thick plate portion 236*a*, a reverse partition wall portion 242 is formed by securing a space between the reverse concave surfaces 241. The reverse partition wall portion 242 is a portion where the reverse surface 240 is exposed, and radially extends in the radial direction with respect to the axis 236*d* of the orifice hole 236*c*. In the second embodiment, the same number of reverse partition wall portions 242 as the number of the front-stage partition wall portions 235*j* are provided on the orifice plate 236 at positions corresponding to the front-stage partition wall portions 235*j* formed on the sleeve main body 235*a*.

In the hydraulic pump unit configured as described above, when the input shaft 10 rotates by rotation of a drive source (not illustrated), the piston 21 reciprocates with rotation of the cylinder block 20. As a result, the oil suctioned into the cylinder bore 20*a* through the suction pipe 50, the orifice hole 236*c*, the sleeve main body 235*a*, the impeller 34, and the low pressure port 24*b* of the valve plate 24 is supplied to various hydraulic devices through the high pressure port 24*a* of the valve plate 24, the discharge passage 31, and an oil passage (not illustrated).

During this time, in the suction passage 32, the impeller 34 that rotates at an increasing speed via the drive gear 14 and the driven gear 13 has a function of increasing the pressure of the oil from the suction pipe 50 to the low pressure port 24*b* of the valve plate 24, thereby making it possible to improve pump suction performance in the variable displacement type swash plate piston pump.

Moreover, with the above-described hydraulic pump unit, even when a swirling reverse flow occurs in the sleeve main body 235*a* at the time of excessive supply operation such as a case in which the input shaft 10 rotates at a high speed, the swirling of the reverse flow is suppressed by the front-stage partition wall portion 235*j* provided on the inner peripheral surface 235*d*, and then the reverse flow is reversed by abutting on the reverse surface 240. That is, the swirling reverse flow of the oil generated in the sleeve main body 235*a* at the time of excessive supply operation is rectified to the flow in the axial direction by abutting on the front-stage partition wall portion 235*j*, is reversed by abutting on the reverse surface 240 of the orifice plate 236, and joins the oil flowing into the orifice hole 236*c* from the suction pipe 50 to accelerate the flow that toward the introduction port 34*c* of the downstream impeller 34. Therefore, even at the time of excessive supply operation, it is possible to prevent problems such as generation of surging and unstable operation due to generation of the reverse flow vortex cavitation.

In particular, in the second embodiment, since the rectifying groove 235*h* has a cylindrical concave shape between the front-stage partition wall portions 235*j*, and the concave spherical surface portions are provided at the upper and lower end portions thereof, it is possible to efficiently introduce a swirling flow of oil into the rectifying groove 235*h* and adjust the swirling flow to a flow in the axial direction of the sleeve 235 regardless of the incident angle of the reverse-flowing oil. Further, since the spherical reverse concave surface 241 is provided on the reverse surface 240 of the orifice plate 236, it is possible to guide the oil downstream toward the axis 235*c* of the sleeve main body 235*a* without disturbing the flow of the oil after passing through the rectifying groove 235*h*, and it is possible to reliably prevent the reverse-flowing oil from reaching the suction pipe 50 on the upstream side beyond the orifice plate 236.

The orifice plate 236 is provided with the reverse partition wall portion 242 between the reverse concave surfaces 241. Therefore, the oil abutting on the reverse surface 240 is guided toward the axis 235*c* of the sleeve main body 235*a* in a state where diffusion in the circumferential direction is restricted by the reverse partition wall portion 242. As a result, the reverse flow of the oil reaching the sleeve main body 235*a* is efficiently reversed in the orifice plate 236, thereby making it possible to improve the pressurizing-and-supplying performance of the oil by the impeller 34 and the pump suction performance in the variable displacement type swash plate piston pump at the time of excessive supply operation.

In the first embodiment, the modification, and the second embodiment described above, a turbo type pump formed at the front stage of a variable displacement type swash plate piston pump is exemplified, but the present disclosure is not necessarily limited thereto, and oil may be directly supplied to a load of hydraulic device or the like by a turbo type pump including an impeller. A fluid is not necessarily oil, and may be other liquid or gas. A drive source for driving a turbo type pump may be a hydraulic motor, a turbine, a windmill, or a waterwheel.

In the first embodiment, the modification, and the second embodiment described above, since the inner diameter of an orifice hole is smaller than the inner diameter of a suction pipe, oil passing through the suction pipe is throttled when passing through an orifice plate, and then is expanded at the upstream portion of a sleeve main body. Therefore, with the above-described hydraulic pump unit, oil reversed by the reverse concave surface of the orifice plate flows along the oil expanded upstream of the sleeve main body, and there is no concern that reverse flow vortex cavitation occurs. However, a relationship between the orifice hole of the orifice plate and the inner diameter of the suction pipe is not limited to the above example, and for example, the orifice hole and the suction pipe may be configured to have the same inner diameter.

Furthermore, in the first embodiment, the modification, and the second embodiment described above, the inner diameter of the upstream portion connected to the orifice plate in the sleeve main body is tapered so as to be larger than the inner diameter of the downstream portion, but the present invention is not necessarily limited thereto. When the sleeve main body is formed in the tapered shape as in the second embodiment, the inner diameter of the orifice hole can be set to the same dimension as that of the introduction port of the impeller, thereby making it possible to prevent a pressure loss from occurring in the oil flowing through the suction pipe.

Furthermore, in the second embodiment described above, a spherical reverse concave surface is provided on the reverse surface, but the reverse surface is not necessarily spherical, and for example, a reverse concave surface having a cylindrical concave shape may be provided so as to be curved only from the outer peripheral side toward the inner peripheral side. In this case as well, it is preferable to provide the reverse concave surface so that the axis of the cylinder, which is the center of curvature, is located on the outer peripheral side of the orifice hole, which is the reduced-diameter portion. In addition, although a rectifying groove forming a cylindrical concave surface and a front-stage partition wall portion are provided on the inner peripheral surface of the sleeve main body, it is not always necessary to provide the rectifying groove and the front-stage partition wall portion. On the other hand, in the first embodiment and the modification, the rectifying groove and the front-stage partition wall portion may be provided on the inner peripheral surface of the sleeve main body.

In the first embodiment, the modification, and the second embodiment described above, reverse partition wall portions are provided at equal intervals in the circumferential direction, but it is not always necessary to provide the reverse partition wall portions at equal intervals. Furthermore, in a case where the reverse partition wall portions are provided at non-equal intervals, it is not always necessary to provide the reverse concave surfaces so as to have the same size, and for example, the size of the reverse concave surfaces may be changed according to the interval between the reverse partition wall portions.

REFERENCE SIGNS LIST

2 PORT BLOCK
32 SUCTION PASSAGE
34 IMPELLER
35, 235 SLEEVE
235*a* SLEEVE MAIN BODY
235*h* RECTIFYING GROOVE
235*j* FRONT-STAGE PARTITION WALL PORTION
36, 136, 236 ORIFICE PLATE
36*a*, 136*a*, 236*c* ORIFICE HOLE
140, 240 REVERSE SURFACE
41, 141, 241 REVERSE CONCAVE SURFACE
42, 142, 242 REVERSE PARTITION WALL PORTION

The invention claimed is:

1. A turbo type pump configured to pressurize a fluid and supply the fluid to a downstream side of a fluid passage by rotation of an impeller provided in the fluid passage, the turbo type pump comprising:

a reduced-diameter portion having a reduced inner diameter in a state of forming a reverse surface facing a downstream side, the reduced-diameter portion being provided at a first portion located on an upstream side of the impeller in the fluid passage; and a reverse partition wall portion provided in the reverse surface and configured to restrict a flow of the fluid in a circumferential direction, wherein a plurality of the reverse partition wall portions are provided at intervals in the circumferential direction of the fluid passage, and wherein a reverse concave surface is provided between the reverse partition wall portions, the reverse concave surface having a curved shape from an outer peripheral side toward an inner peripheral side of the fluid passage.

2. The turbo type pump according to claim 1, wherein the plurality of the reverse partition wall portions extend radially with respect to an axis of the reduced-diameter portion.

3. The turbo type pump according to claim 1, wherein the plurality of the reverse partition wall portions extend so as to be inclined in a rotation direction of the impeller from the outer peripheral side toward the inner peripheral side with respect to a radius passing through an axis of the reduced-diameter portion.

4. The turbo type pump according to claim 1, wherein the reverse concave surface is provided so that a center of curvature is located closer to an outer peripheral side of the reduced-diameter portion.

5. The turbo type pump according to claim 1, wherein the reverse concave surface is formed in a spherical shape.

6. The turbo type pump according to claim 1, wherein a plurality of front-stage partition wall portions configured to restrict the flow of the fluid in the circumferential direction is provided on an inner peripheral surface of a second portion located between the reduced-diameter portion and the impeller in the fluid passage.

7. The turbo type pump according to claim 6, wherein the portion located between the reduced-diameter portion and the impeller in the fluid passage extends linearly in a rotation axis of the impeller, wherein the plurality of front-stage partition wall portions are provided at a position corresponding to respective reverse partition wall portions, wherein a rectifying groove having a cylindrical concave shape that is provided between the plurality of front-stage partition wall portions.

8. The turbo type pump according to claim 1, wherein a second portion located between the reduced-diameter portion and the impeller in the fluid passage is formed in a tapered shape so that an inner diameter of the second portion gradually increases toward an upstream side.

9. The turbo type pump according to claim 8, wherein an inner diameter of an introduction port communicating with the impeller in the fluid passage coincides with an inner diameter of the reduced-diameter portion.

10. A fluid supply unit comprising: the turbo type pump according to claim 1; and a positive displacement pump connected to a third portion of the fluid passage, the third portion being located on the downstream side of the impeller.

* * * * *